US008726464B1

(12) United States Patent
Tong

(10) Patent No.: US 8,726,464 B1
(45) Date of Patent: May 20, 2014

(54) LUGGAGE HANDLE STRUCTURE

(71) Applicant: Joy Tong, Boca Raton, FL (US)

(72) Inventor: Joy Tong, Boca Raton, FL (US)

( * ) Notice: Subject to any disclaimer, the term of this patent is extended or adjusted under 35 U.S.C. 154(b) by 0 days.

(21) Appl. No.: 13/861,361

(22) Filed: Apr. 11, 2013

(51) Int. Cl.
*A45C 7/00* (2006.01)

(52) U.S. Cl.
USPC ..... 16/113.1

(58) Field of Classification Search
CPC ..... A45C 13/26; A45C 2013/26; A45C 2013/267; A45C 2013/262; B62B 5/06; B62B 5/067; B62B 5/065
USPC ..... 16/113.1, 405, 429; 190/18 A, 115; 280/47.371, 47.17, 655, 655.1; 403/109.3, 109.6, 109.7, 109.2, 109.5
See application file for complete search history.

(56) References Cited

U.S. PATENT DOCUMENTS 3,513,952 A * 5/1970 Warner, Jr. ..... 16/113.1
5,414,895 A * 5/1995 Kazmark, Jr. ..... 16/113.1
5,553,350 A * 9/1996 Chang ..... 16/113.1
5,893,196 A * 4/1999 Tserng ..... 16/405
5,984,064 A * 11/1999 Byington ..... 190/115
6,026,542 A * 2/2000 Lu ..... 16/113.1
6,061,871 A * 5/2000 Wang ..... 16/113.1
6,374,457 B1 * 4/2002 Kuo ..... 16/113.1
6,508,344 B1 * 1/2003 Lu ..... 190/115
6,920,666 B1 * 7/2005 Chen ..... 16/113.1
7,188,715 B1 * 3/2007 Chen ..... 190/115
7,467,696 B2 * 12/2008 Wu ..... 190/115
7,658,269 B2 * 2/2010 Wu ..... 190/115

* cited by examiner

*Primary Examiner* — Chuck Mah
(74) *Attorney, Agent, or Firm* — Pai Patent & Trademark Law Firm; Chao-Chang David Pai

(57) ABSTRACT

A luggage handle structure includes two pull rods having linkage rods therein, a handle unit connected between the two pull rods and having an accommodation hole leading to two ends thereof, and a press unit. The press unit includes a press rod assembly which is movably disposed in the accommodation hole. The press rod assembly has two ends as press portions which are exposed out of the accommodation hole and push portion corresponding in position to the two pull rods. Each push portion has two first inclined planes to form a V shape against the upper end of the corresponding linkage rod. No matter either press portion is pressed, the push portions of the two ends will push the two pull rods simultaneously to release a locking mechanism.

15 Claims, 7 Drawing Sheets

SECTION B-B

SECTION A-A

LUGGAGE HANDLE STRUCTURE

BACKGROUND OF THE INVENTION (a) Field of the Invention

The present invention relates to a luggage handle structure, and more particularly to a retractable handle structure coupled to a luggage.

(b) Description of the Prior Art

In general, a luggage is provided with a retractable handle. The retractable handle has a release mechanism to pull out or retract the handle. There are various release mechanisms on the market. One of the release mechanisms is that two ends of the handle are respectively provided with a release button as shown in U.S. Pat. No. 7,658,269, U.S. Pat. No. 7,188,715 and U.S. Pat. No. 5,984,064. The retractable handle comprises two retractable pull rods and a handle connected between the two retractable pull rods. Both ends of the handle must be provided with the release buttons. Linkage rods in the two retractable pull rods and a locking mechanism are required to bring two retractable pull rods synchronously when either of the release buttons is pressed, such that the linkage rods unlock the locking mechanism of the retractable pull rods.

A conventional release mechanism is shown in U.S. Pat. No. 7,658,269. The handle comprises a gear therein. Two sides of the gear are respectively provided with a rack and a spring. The two racks extend to the two ends of the handle. The two ends of the handle are provided with release buttons connected with the racks. When either of the release buttons is pressed, the rack brings the gear so that the two racks are moved inward synchronously. On the contrary, the two racks are moved outward synchronously. Besides, because of the configuration of the two racks and the relationship of operation, the two racks must have an oblique hole. The inner wall of the oblique hole forms two parallel oblique planes. The upper end of the linkage rod in the pull rod forms an oblique rod. The oblique rod is inserted into the oblique hole of each rack, so that the two racks are moved inward or outward synchronously to bring the linkage rods. This release mechanism is quite complicated, and cannot be manufactured and assembled with ease, and has a high cost. For example, if the oblique hole is formed by plastic molding, the structure of the mold becomes very complicated.

Accordingly, the inventor of the present invention has devoted himself based on his many years of practical experiences to solve these problems.

SUMMARY OF THE INVENTION

The primary object of the present invention is to provide a luggage handle structure which comprises a handle unit and a press unit disposed in the handle unit. The press unit comprises a press rod assembly and at least one elastic member. The lower surfaces of the two ends of the press rod assembly have push portions corresponding in position to the pull rods. Each push portion has two symmetrical first inclined planes. The two first inclined planes form a V shape. A linkage rod provided in each the pull rod is against the V-shaped first inclined planes of the push portion. No matter either press unit is pressed, the push portions of the two ends will push the two pull rods simultaneously to release the locking state. The present invention has a simple release configuration, and can be manufactured and assembled easily, and lowers the cost greatly.

A further object of the present invention is to provide a luggage handle structure which comprises a press rod assembly. The press rod assembly comprises a slide rod, two buttons and an elastic member. The configuration of the press rod assembly is very simple.

Another object of the present invention is to provide a luggage handle structure which comprises a pair of handle connectors coupled to the ends of two pull rods. The handle connector is formed with plastic, which can be manufactured and assembled easily.

The other objects of the present invention are to provide a luggage handle structure which has a simple release configuration and can be manufactured and assembled easily.

DETAILED DESCRIPTION OF THE PREFERRED EMBODIMENTS

Embodiments of the present invention will now be described, by way of example only, with reference to the accompanying drawings.

Figure 1:
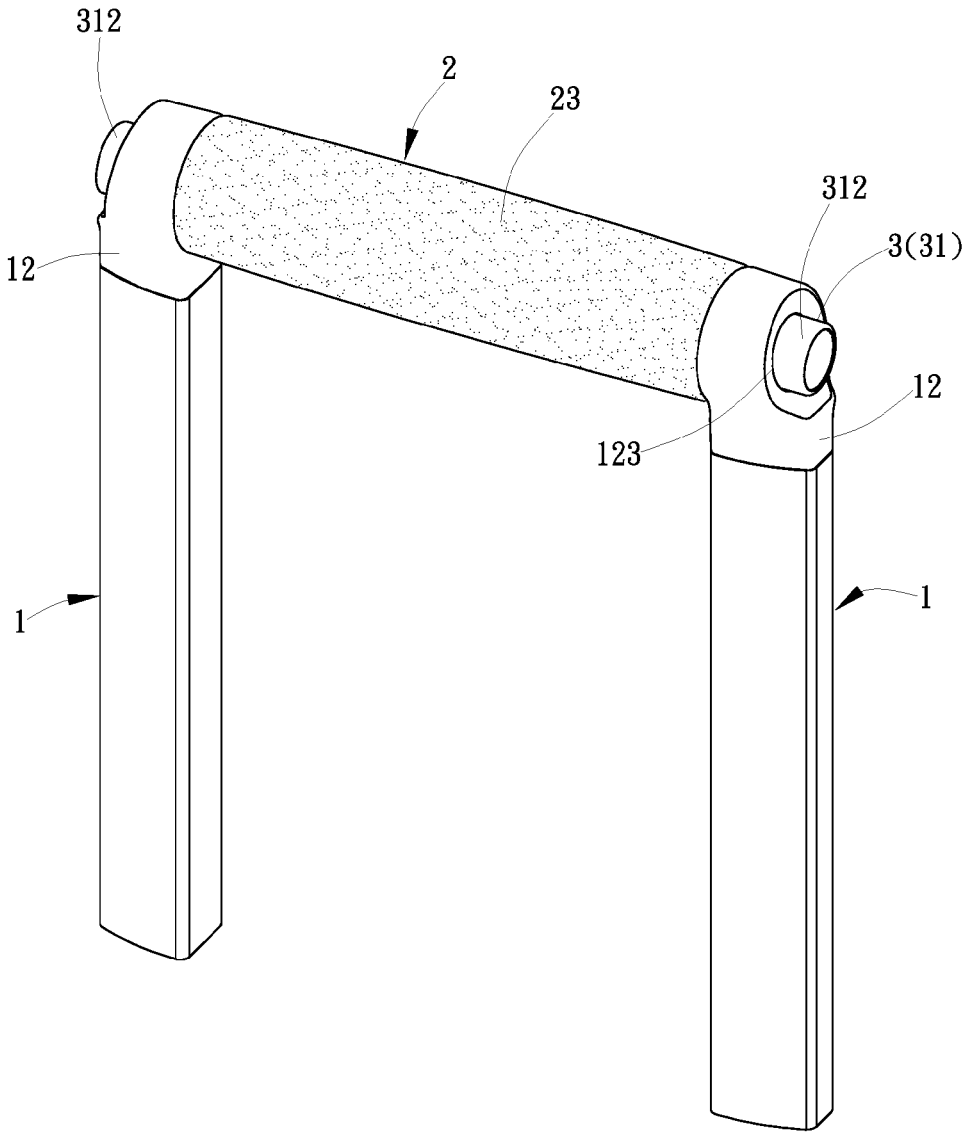
FIG. 1 is a perspective view of the luggage handle structure of the present invention.
Figure 2:
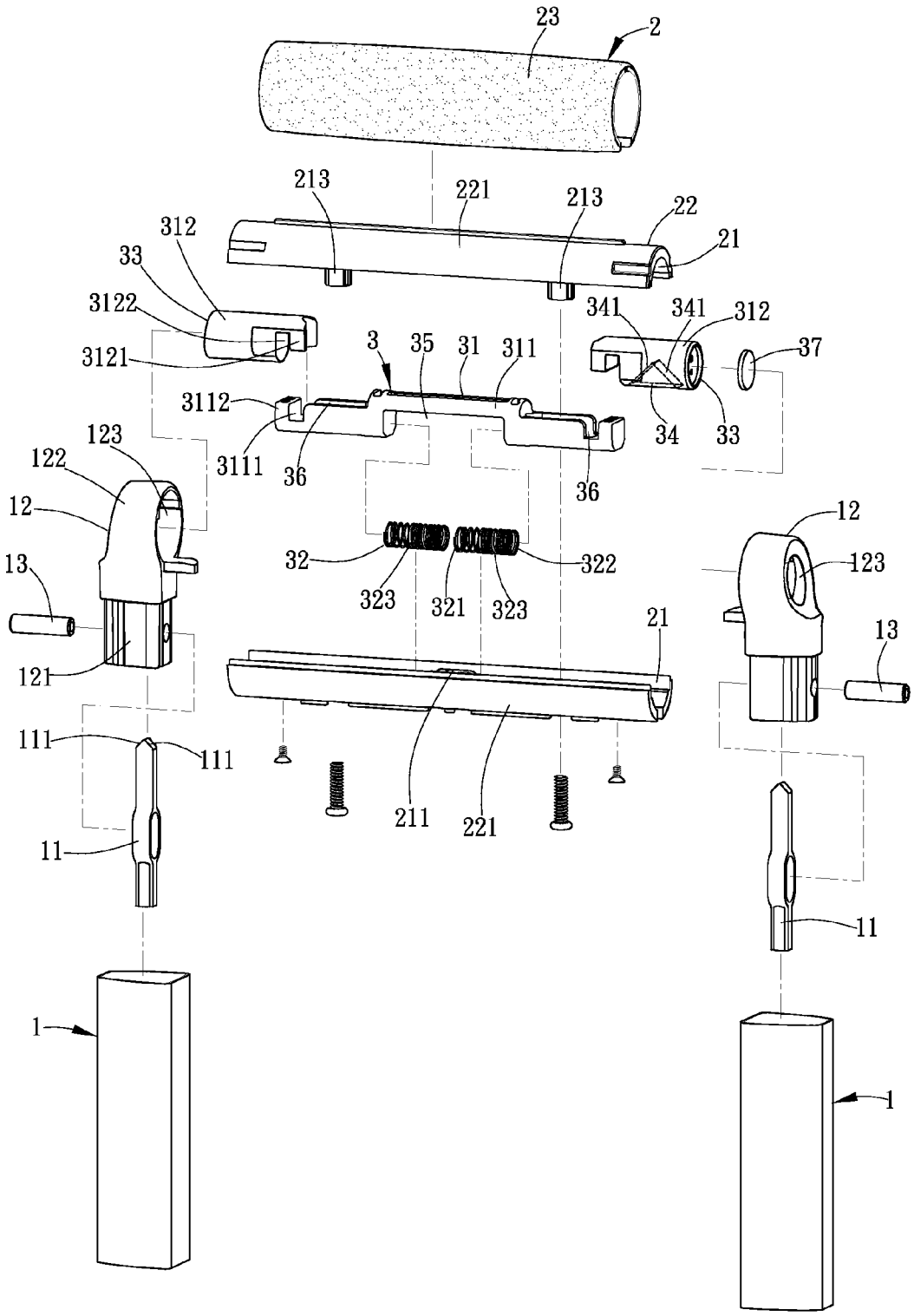
FIG. 2 is an exploded view of the luggage handle structure of the present invention.

As shown in FIG. 1 and FIG. 2, the luggage handle structure according to a preferred embodiment of the present invention comprises two retractable pull rods 1 coupled to a luggage, a handle unit 2 connected between the two pull rods 1, and a press unit 3 disposed in the handle unit 2.

Figure 4:
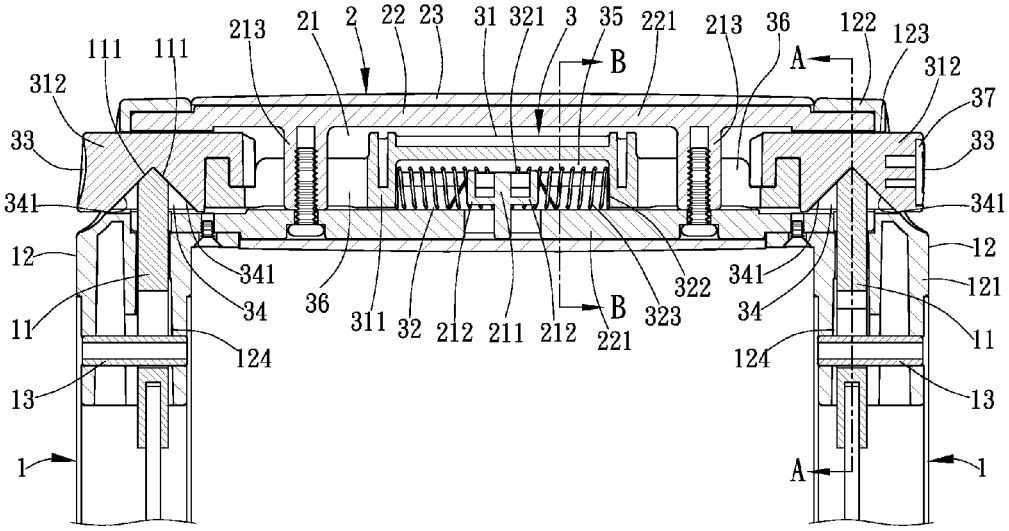
FIG. 4 is a front sectional view of the luggage handle structure of the present invention.
Figure 6:
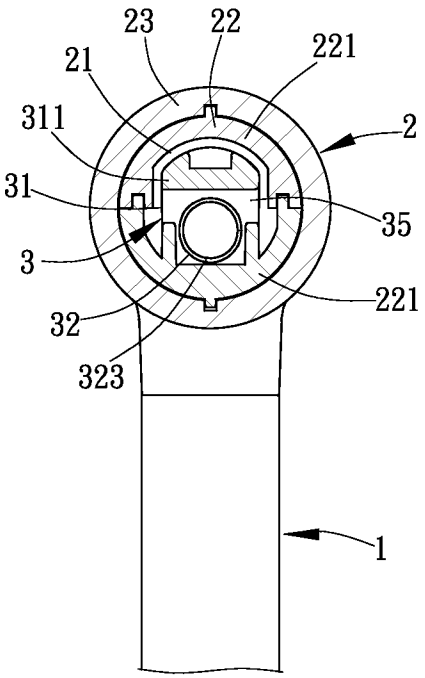
FIG. 6 is a sectional view taken along line B-B of FIG. 4.
Figure 7:
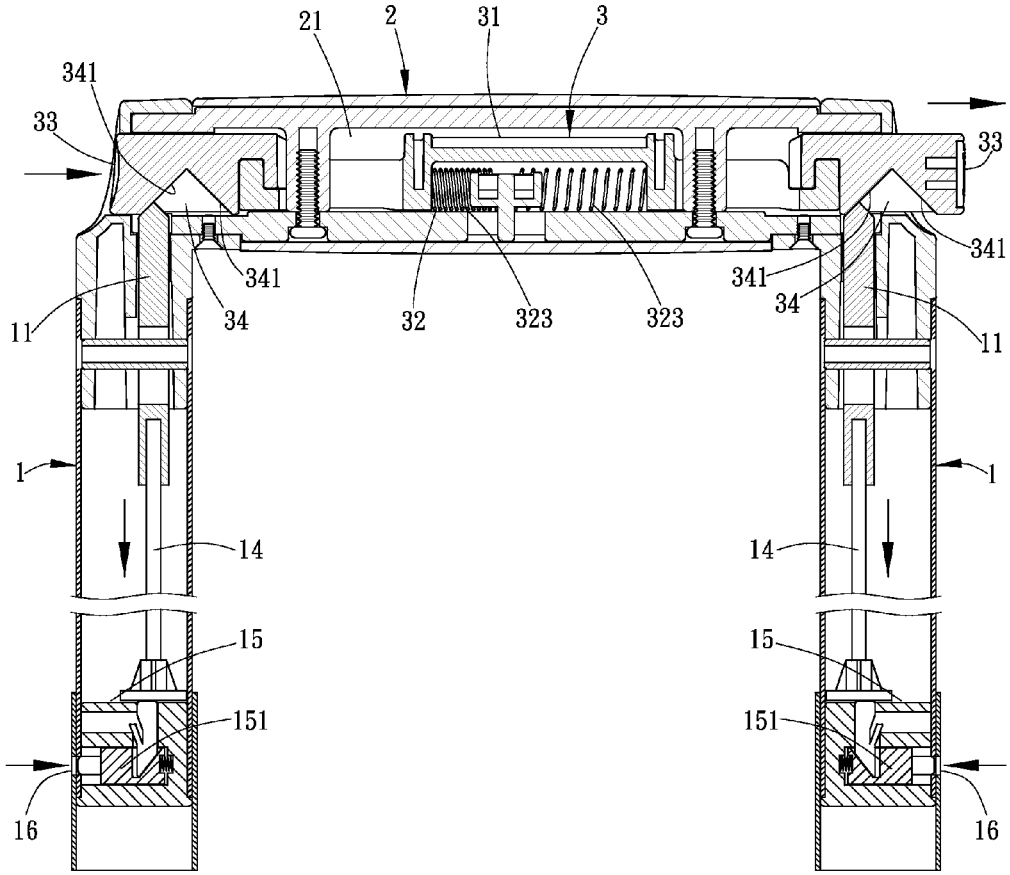
FIG. 7 is a schematic view of the luggage handle structure of the present invention in a first use state.
Figure 8:
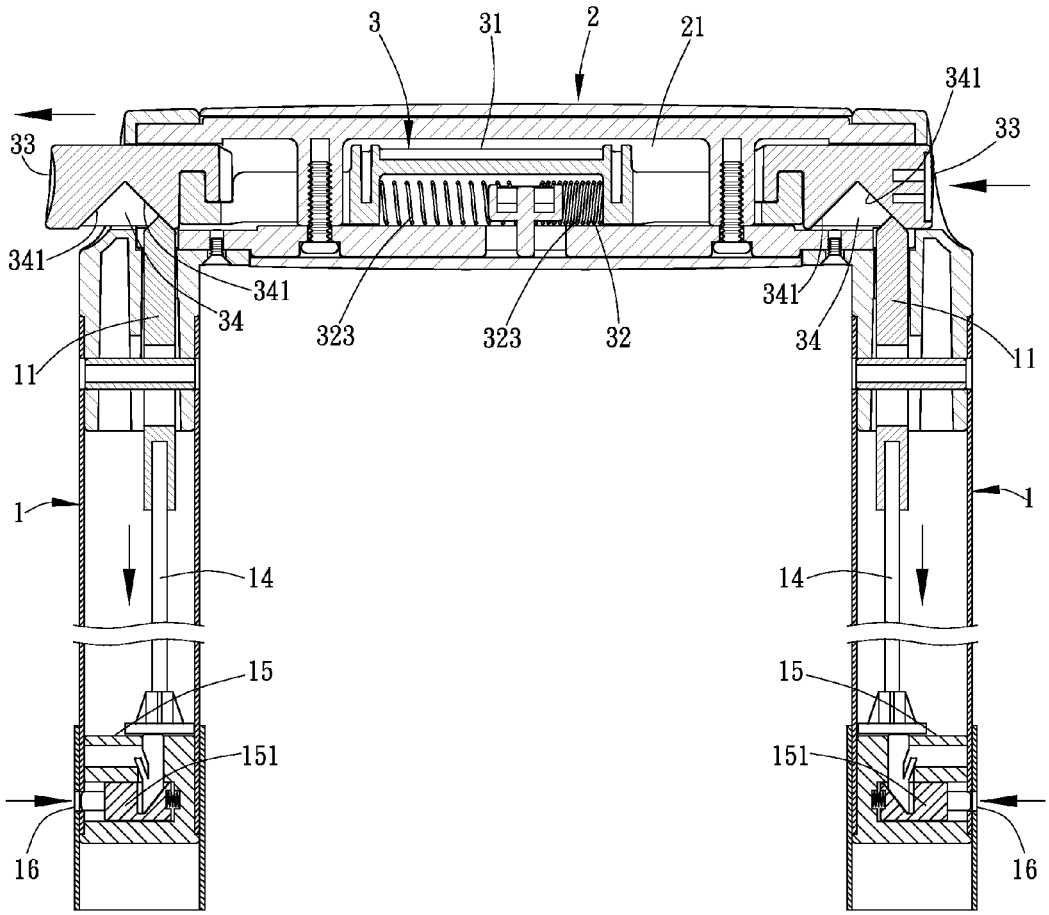
FIG. 8 is a schematic view of the luggage handle structure of the present invention in a second use state.

As shown in FIG. 2 and FIG. 4, each pull rod 1 is a hollow rod made of aluminum alloy or other materials. Each pull rod 1 comprises a movable linkage rod 11 therein. The upper end of each pull rod 1 is connected with a handle connector 12. The upper end of the linkage rod 11 has two second inclined planes 111. The two second inclined planes 111 form a V shape. The handle connector 12 is formed with plastic. The handle connector 12 comprises an insertion rod 121 which is inserted into the corresponding pull rod 1, a head portion 122 formed on top of the insertion rod 121, a transverse through hole 123 formed in the head portion 122 for connection of the handle unit 2, and a linkage rod hole 124 formed in the insertion rod 121 and communicating with the through hole 123. The linkage rod 11 is inserted in the linkage rod hole 124 and a pin 13 is inserted through the linkage rod 11, such that the upper end of the linkage rod 11 is against the press unit 3 and moved up and down by the press unit 3 further to bring a push rod 14, as shown in FIG. 7 and FIG. 8. The push rod 14 is further to bring a lock mechanism 15 inside each pull rod 1 to unlock a locking member 151 of the locking mechanism 15.

Figure 5:
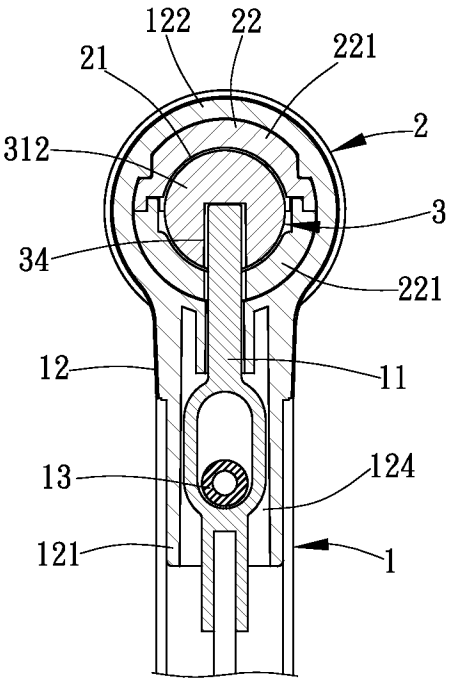
FIG. 5 is a sectional view taken along line A-A of FIG. 4.

As shown in FIG. 2, FIG. 4 and FIG. 5, the handle unit 2 is a transverse rod for the user to hold thereon, which can be composed of a plurality of parts or one-piece. One end of the handle unit 2 is coupled to one pull rod 1, and another end of the handle unit 2 is coupled to the other pull rod 1. The handle unit 2 has an accommodation hole 21 therein. The accommodation hole 21 leads to the two ends of the handle unit 2. Preferably, the handle unit 2 is composed of a plurality of parts. The handle unit 2 comprises an inner pipe 22 and an outer pipe 23. The inner pipe 22 is composed of two connected semicircle pipes 221. The accommodation hole 21 is formed inside the inner pipe 22. The outer pipe 23 is a one-piece cylinder. The outer pipe 23 is fitted on the inner pipe 22 and two ends of the inner pipe 22 are exposed out of the outer pipe 23, so that the two ends of the inner pipe 22 are respectively inserted in the through hole 123 of the handle connector 12. Thus, the two ends of the inner pipe 22 are respectively coupled to the pull rods 1.

Figure 3:
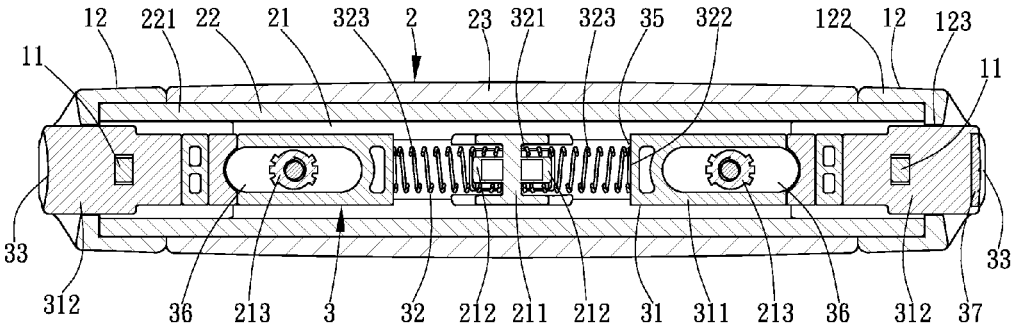
FIG. 3 is a top sectional view of the luggage handle structure of the present invention.

As shown in FIG. 2, FIG. 3 and FIG. 4, the press unit 3 is adapted for the user to press thereon to control the linkage rod 11 inside the pull rod 1 to activate a release mechanism. Preferably, the press unit 3 comprises a press rod assembly 31 and an elastic member 32. The press rod assembly 31 is movably disposed in the accommodation hole 21 of the handle unit 2. Two ends of the press rod assembly 31 have press portions 33 exposed out of two ends of the accommodation hole 21 and push portions 34 corresponding in position to the pull rods 1. Each push portion 34 has two symmetrical first inclined planes 341. The two first inclined planes 341 form a V shape. The two first inclined planes 341 are against the two second inclined surface 111 of the upper end of the linkage rod 11. The elastic member 32 is used to return the press rod assembly 31. The elastic member 32 has a first elastic end 321 coupled to the handle unit 2 and a second elastic end 322 against the press rod assembly 31.

As shown in FIG. 2 and FIG. 4, the press rod assembly 31 has a recess 35 at one side thereof. The elastic member 32 is two spiral springs 323 accommodated in the recess 35. One end of each spiral spring 323 is the first elastic end 321, and another end of each spiral spring 323 is the second elastic end 322. The first elastic end 321 is held in the accommodation hole 21 of the handle unit 2, and the second elastic end 322 is against one end of the recess 35. When the user presses one of the press portions 33 of the press rod assembly 31, the spiral spring 323 can push the press rod assembly 31 to return to its original position. As shown in FIG. 3 and FIG. 4, for the first elastic end 321 of the spiral spring 323 to be held in the accommodation hole 21, a fixing seat 211 is formed at the center of the accommodation hole 21. Two ends of the fixing seat 211 have protruding posts 212 for connection of the first elastic ends 321 of the two spiral springs 323 so as to be assembled quickly.

FIG. 3 and FIG. 4, the press rod assembly 31 can be moved in the accommodation hole 21 of the handle unit 2, without disengagement. One side of the press rod assembly 31 has an axial limit hole 36. The handle unit 2 has a limit post 213 disposed in the accommodation hole 21 to be inserted in the limit hole 36. Through the configuration of the limit post 213 and the limit hole 36, when the press rod assembly 31 is pressed and moved by the user or returned back by the spiral spring 323, the press rod assembly 31 won't disengage from the accommodation hole 21.

As shown in FIG. 2 and FIG. 4, the press rod assembly 31 of the present invention can be integrally formed or composed of segments. In a preferred embodiment, the press rod assembly 31 comprises a slide rod 311 and two buttons 312. The slide rod 311 is movably disposed in the accommodation hole 21. One side of the slide rod 311 is formed with the recess 35 to accommodate the elastic member 32. The second elastic end 322 is against the slide rod 311. One side of the slide rod 311 may be formed with the limit hole 36 for insertion of the limit post 213. The two buttons 312 are connected to two ends of the slide rod 311. The outer end of each button 312 functions as the press portion 33 and is exposed out of the accommodation hole 21. Each button 312 has the push portion 34 corresponding in position to the pull rod 11.

As shown in FIG. 2 and FIG. 4, for the slide rod 311 and the buttons 312 to be connected quickly and easily, two ends of the slide rod 311 each have a first concave portion 3111 and a first convex portion 3112. Each button 312 has a second convex portion 3121 to engage with the first concave portion 3111 and a second concave portion 3122 to engage with the first convex portion 3112 so that the buttons 312 are connected to the slide rod 311. In additional, the outer end of each button 312 has a hole and a brand block coupled to the hole. The surface of the brand block 37 can be applied with brand mark.

Figure 10:
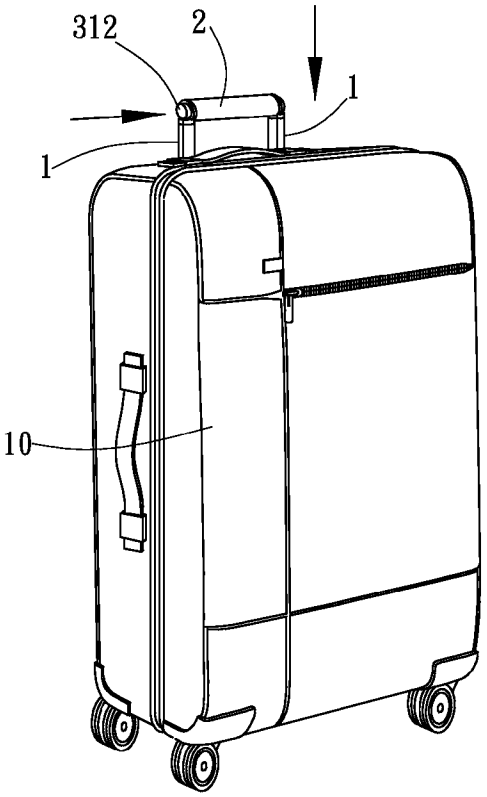
FIG. 10 is a schematic view to show that the luggage handle is retracted.
Figure 9:
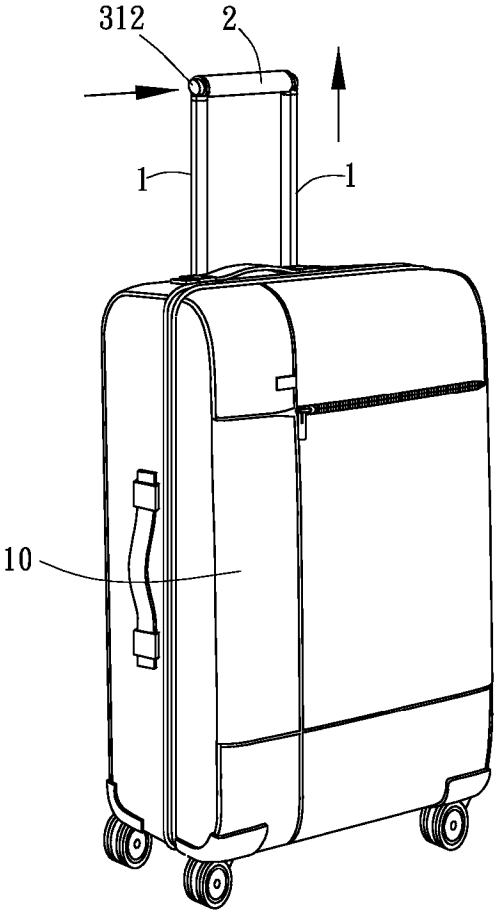
FIG. 9 is a schematic view to show that the luggage handle is extended.

To practice the present invention, as shown in FIG. 9 and FIG. 10, the pull rods 1 are installed on the back of the luggage 10. When the present invention is used, as shown in FIG. 7 and FIG. 8, the user can press the press portion 33 of either of the ends of the press rod assembly 31 (FIG. 7 shows the left end is pressed, and FIG. 8 shows the right end is pressed) so that the press rod assembly 31 is retracted into the accommodation hole 21 of the handle unit 2. The V-shaped configuration of the two first inclined planes 341 of each push portion 34 is to push the linkage rod 11 of the corresponding pull rod 1, such that the linkage rod 11 is descended to bring the push rod 14 in the pull rod 1. The push rod 14 is further to bring (press down) the lock mechanism 15 inside the lower end of the pull rod 1. The locking member 151 of the locking mechanism 15 is compressed to release the locking state. Thus, the pull rod 1 can be extended or retracted, as shown in FIG. 9 and FIG. 10. On the contrary, when the user releases the press portion 33, the press rod assembly 31 is returned by the elastic member 32 (the spiral spring 323) and the two push portions 34 are returned to their original positions, such that the linkage rods 11 of the pull rods 1 are ascended to their original positions. The locking member 151 of the locking mechanism 15 is engaged with a position hole 16 of the pull rod 1 again.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A luggage handle structure, comprising:

two retractable pull rods for coupling to a luggage, each pull rod being a hollow rod and comprising a movable linkage rod therein, a push rod connected to a lower end of the linkage rod, and a locking mechanism connected to a lower end of the push rod;

a handle unit connected between the two pull rods, one end of the handle unit being coupled to one pull rod and another end of the handle unit being coupled to the other pull rod, the handle unit having an accommodation hole therein, the accommodation hole leading to the two ends of the handle unit; and a press unit disposed in the handle unit, the press unit comprising a press rod assembly and at least one elastic member, the press rod assembly being movably disposed in the accommodation hole of the handle unit, two ends of the press rod assembly having press portions exposed out of two ends of the accommodation hole and push portions corresponding in position to the pull rods, each push portion having two symmetrical first inclined planes, the two first inclined planes being against an upper end of the linkage rod, the at least one elastic member each having a first elastic end coupled to the handle unit and a second elastic end against the press rod assembly;

whereby when either of the press portions is pressed, the press rod assembly is retracted against the at least one elastic member, causing the upper end of each of the linkage rods to move along the first inclined planes of the corresponding push portion, thereby pushing down the connected push rod to unlock a locking member of the connected locking mechanism, thus allowing both pull rods to be extended or retracted; and when the press portion is released, the press rod assembly is returned to the original position by the at least one elastic member.

2. The luggage handle structure as claimed in claim 1, wherein the two first inclined planes form a V shape.

3. The luggage handle structure as claimed in claim 2, wherein the upper end of the linkage rod has two second inclined planes, and the two second inclined planes form a V shape.

4. The luggage handle structure as claimed in claim 1, wherein the press rod assembly has a recess at one side thereof, the at least one elastic member comprises two spiral springs accommodated in the recess, one end of each spiral spring is the first elastic end, another end of each spiral spring is the second elastic end, the first elastic end is held in the accommodation hole of the handle unit, and the second elastic end is against one end of the recess.

5. The luggage handle structure as claimed in claim 4, wherein a fixing seat is provided at the center of the accommodation hole, and two ends of the fixing seat have protruding posts for connection of the first elastic ends of the two spiral springs.

6. The luggage handle structure as claimed in claim 1, wherein one side of the press rod assembly has an axial limit hole, and the handle unit has a limit post disposed in the accommodation hole to be inserted in the limit hole.

7. The luggage handle structure as claimed in claim 1, wherein the press rod assembly comprises a slide rod and two buttons, the slide rod is movably disposed in the accommodation hole, the two buttons are connected to two ends of the slide rod, outer ends of the two buttons function as the press portions and are exposed out of the accommodation hole, the two buttons have the push portions corresponding in position to the pull rods, and the second elastic end of the at least one elastic member is against the slide rod.

8. The luggage handle structure as claimed in claim 7, wherein the outer end of each of the two buttons has a hole and a brand block coupled to the hole.

9. The luggage handle structure as claimed in claim 7, wherein two ends of the slide rod each have a first concave portion and a first convex portion, and each of the two buttons has a second convex portion to engage with the first concave portion and a second concave portion to engage with the first convex portion so that the two buttons are connected to the slide rod.

10. The luggage handle structure as claimed in claim 7, wherein the slide rod has a recess at one side thereof, the at least one elastic member comprises two spiral springs accommodated in the recess, one end of each spiral spring is the first elastic end, another end of each spiral spring is the second elastic end, the first elastic end is held in the accommodation hole of the handle unit, and the second elastic end is against one end of the recess.

11. The luggage handle structure as claimed in claim 10, wherein a fixing seat is provided at the center of the accommodation hole, and two ends of the fixing seat have protruding posts for connection of the first elastic ends of the two spiral springs.

12. The luggage handle structure as claimed in claim 7, wherein one side of the slide rod has an axial limit hole, and the handle unit has a limit post disposed in the accommodation hole to be inserted in the limit hole.

13. The luggage handle structure as claimed in claim 1, wherein the handle unit comprises an inner pipe and an outer pipe, the inner pipe is composed of two connected semicircle pipes, the accommodation hole is formed inside the inner pipe, the outer pipe is a one-piece cylinder, and the outer pipe is fitted on the inner pipe.

14. The luggage handle structure as claimed in claim 13, wherein two ends of the inner pipe are exposed out of the outer pipe, and the two ends of the inner pipe are respectively coupled to the pull rods.

15. The luggage handle structure as claimed in claim 14, wherein an upper end of each of the pull rods is connected with a handle connector, the handle connector is formed with plastic, and the handle connector comprises an insertion rod which is inserted into the corresponding pull rod, a head portion formed on top of the insertion rod, and a transverse through hole formed in the head portion for connection of the handle unit.

* * * * *